United States Patent [19]

Brendel

[11] 4,412,432

[45] Nov. 1, 1983

[54] REFRIGERATION SYSTEM AND A FLUID FLOW CONTROL DEVICE THEREFOR

[75] Inventor: Thomas E. Brendel, Fayetteville, N.Y.

[73] Assignee: Carrier Corporation, Syracuse, N.Y.

[21] Appl. No.: 364,829

[22] Filed: Apr. 2, 1982

[51] Int. Cl.[3] ..... F25B 39/02

[52] U.S. Cl. ..... 62/504; 62/511; 62/527; 137/852; 138/44

[58] Field of Search ..... 62/504, 511, 527; 138/40, 44; 137/852

[56] References Cited

U.S. PATENT DOCUMENTS 2,908,283 10/1959 Kiffer et al. ..... 137/845

3,866,439 2/1975 Bussjager et al. ..... 62/504

*Primary Examiner*—Ronald C. Capossela

*Attorney, Agent, or Firm*—David J. Zobkiw

[57] ABSTRACT

A variable capacity refrigeration system and a fluid flow control device particularly well suited for use therewith. The fluid flow control device includes a body, a Belleville spring, and a plug. The body defines a fluid flow passage, and the plug is secured therewithin. The Belleville spring is positioned within the fluid flow passage and includes an inside edge defining a radially extending spring port for conducting fluid through the spring. The Belleville spring has a normal position, where the inside edge of the spring engages the plug to close the spring port, and an overcenter position, where the inside edge of the spring is spaced from the plug to allow fluid flow through the spring port.

6 Claims, 2 Drawing Figures

REFRIGERATION SYSTEM AND A FLUID FLOW CONTROL DEVICE THEREFOR

BACKGROUND OF THE INVENTION

Figure 1:
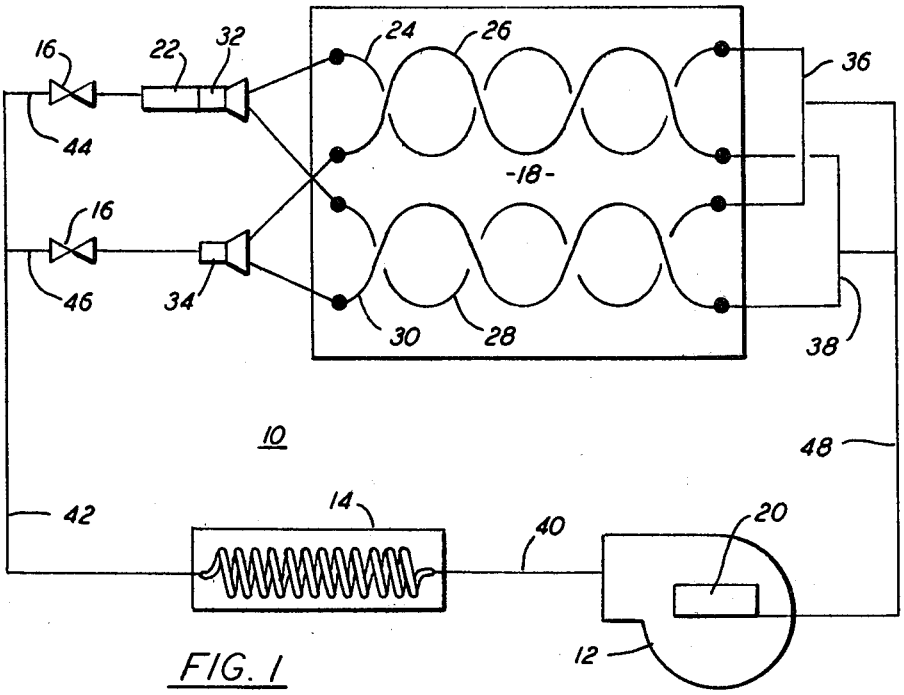

This invention generally relates to variable capacity vapor compression refrigeration systems, and more specifically to a fluid flow control device particularly well suited for use with such refrigeration systems.

Vapor compression refrigeration systems generally comprise a compressor, a condenser, expansion means, and an evaporator connected together by appropriate refrigerant lines to form a closed loop refrigeration circuit. Refrigerant vapor is compressed by the compressor and fed to the condenser where the refrigerant releases heat to a cooling medium and condenses. The condensed refrigerant then flows through the expansion means, reducing the pressure of the refrigerant. From the expansion means, the refrigerant passes into the evaporator, absorbs ambient heat, and vaporizes. Vaporous refrigerant is then drawn back into the compressor, completing the circuit.

Refrigeration systems of the foregoing type are often used in situations such as commercial and industrial buildings where the load upon the system may vary over a wide range. Commonly, the refrigeration system is designed to meet the maximum load to which it may be subjected, and when the system operates under lower load conditions, the capacity of the refrigeration system is reduced. Frequently, such a refrigeration system has a variable capacity compressor, and system capacity is reduced by reducing the compressor capacity. For example, if the refrigeration system has a reciprocating piston type compressor, system capacity may be reduced by partially or completely unloading one or more of the piston cylinders of the compressor.

Variable capacity refrigeration systems generally include an evaporator having a plurality of groups of refrigerant circuits and a plurality of evaporator inlet lines for conducting refrigerant to the evaporator circuit groups. Each group of circuits is supplied with refrigerant from a different one of the evaporator inlet lines and; under low load operating conditions, when the capacity of the refrigeration system is reduced, one or more of these evaporator inlet lines is closed, removing from operation the evaporator circuit group or groups fed by the closed inlet line or lines. As is understood in the art, removing selected evaporator circuits from operation in response to reduced system capacity improves system performance by, inter alia, maintaining high fluid velocities through the evaporator and thus preventing an excessive accumulation of lubricant therein.

Heretofore, solenoid operated valves have usually been used to close the selected evaporator inlet lines. To elaborate, one or more of the evaporator inlet lines of a refrigeration system are each provided with a valve, with each of these valves connected to a different electrically operated solenoid. Normally, the valves are all in open positions, allowing fluid flow through the selected evaporator inlet lines. By activating the solenoids, the valves are moved to closed positions, preventing fluid flow through the selected evaporator inlet lines. The valves are returned to their open positions by deactivating the solenoids. These solenoids, in turn, are activated by a thermal or pressure sensitive switch that senses a parameter indicative of the operating condition of the refrigeration system and that closes, and thus activates the solenoids, when the capacity of that refrigeration system is reduced below a predetermined level.

While these prior art solenoid arrangements are very effective, they are also relatively expensive. In particular, the solenoid valves themselves are comparatively expensive items. In addition, the control for the solenoids, usually including at least one electrically conductive thermal or pressure sensitive switch, also represents a significant cost.

SUMMARY OF THE INVENTION

An object of this invention is to provide a refrigeration system with a very inexpensive and reliable fluid flow control device which moves from a full open position to a full closed position to close a circuit of an evaporator of the refrigeration system when the capacity of the refrigeration system is reduced below a predetermined level, without requiring any external sensor to sense the capacity of the refrigeration system.

Another object of the present invention is to provide a very simple, self-activating fluid flow control device to close a fluid line when the fluid pressure forces therein fall below a preset level.

These and other objects are attained with a refrigeration system comprising a compressor, a condenser, expansion means, and an evaporator including first and second evaporator circuits. The refrigeration system further comprises means to vary or control the capacity of the refrigeration system, and first and second evaporator inlet lines for conducting refrigerant to the first and second evaporator circuits respectively. The first evaporator inlet line is provided with a fluid flow control device for controlling refrigerant flow through the first evaporator inlet line.

This fluid flow control device, in turn, includes a body and a Belleville spring. The body defines a body inlet, a body outlet, a fluid flow passage axially extending therebetween, and first and second axially spaced apart shoulders. The Belleville spring is positioned within the fluid flow passage and includes an outside edge and an inside edge. The outside edge is located and held between the first and second shoulders, and the inside edge defines a spring port for conducting fluid through the Belleville spring.

The fluid flow control device further comprises means defining a stop surface disposed within the body and completely overlaying the spring port. The Belleville spring has a first position, where the inside edge of the spring engages the stop surface to close the spring port and prevent fluid flow therethrough, and a second position, where the inside edge of the Belleville spring is spaced from the stop surface to allow fluid flow through the spring port. The Belleville spring is actuated from the first position to the second position by a predetermined fluid force acting thereon.

A BRIEF DESCRIPTION OF THE DRAWING

Figure 2:
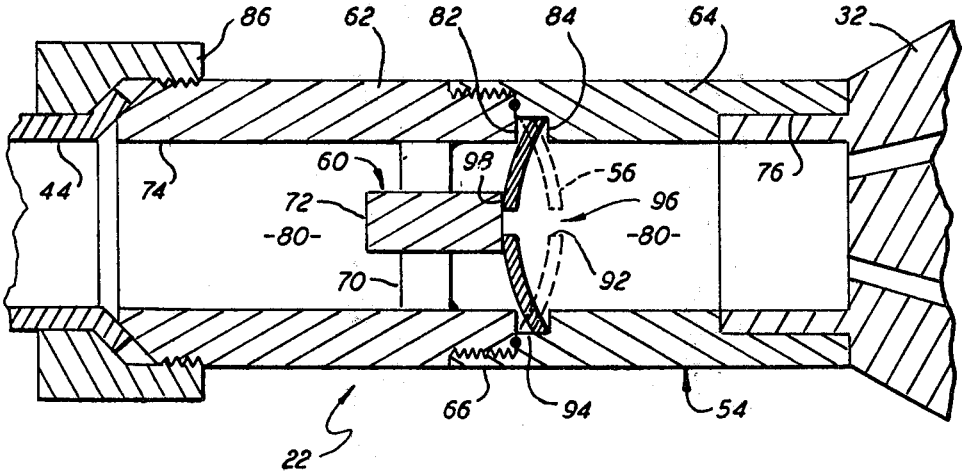

FIG. 1 is a schematic drawing of a vapor compression refrigeration system in accordance with a preferred embodiment of the present invention; and FIG. 2 is a longitudinal, cross-sectional view of a fluid flow control device of the refrigeration system shown in FIG. 1.

A DETAILED DESCRIPTION OF THE PREFERRED EMBODIMENT

Referring to FIG. 1, there is illustrated vapor compression refrigeration system 10. Generally, system 10 comprises compressor 12, condenser 14, expansion means 16, evaporator 18, capacity control means 20, and fluid flow control device 22, with evaporator 18, in turn, including first and second evaporator circuits 24 and 26. Preferably, evaporator 18 further includes third and fourth evaporator circuits 28 and 30, expansion means 16 includes two separate expansion devices, and system 10 further comprises distributors 32 and 34 and headers 36 and 38. With the exception of fluid flow control device 22, discussed in greater detail below, the elements of refrigeration system 10 may be well known and function in a normally expected manner. For example, compressor 12 may be a reciprocating piston compressor, capacity control means 20 may comprise means to unload one or more of the piston cylinders of the compressor, and expansion devices 16 may be conventional capillary tubes or thermal expansion valves. Also, condenser 14 and evaporator 18 may be conventional fin-tube heat exchangers, with evaporator circuits 24, 26, 28, and 30 each comprising a multitude of tubes extending through the heat exchanger and connected together to form a continuous, serpentine shaped fluid circuit.

In operation, compressor 12 discharges hot, compressed refrigerant vapor into high pressure, compressor discharge line 40, which conducts the refrigerant to condenser 14. The refrigerant is conducted through condenser 14, gives up heat to the ambient, and condenses; and liquid refrigerant proceeds from condenser 14 through line 42, and into evaporator inlet lines 44 and 46. When refrigeration system 10 is operating at maximum capacity, refrigerant passes through both lines 44 and 46 and through both expansion devices 16. The pressure of the refrigerant decreases as it passes through expansion devices 16, and expanded refrigerant proceeds through fluid flow control device 22 and is fed by distributors 32 and 34 into evaporator circuits 24, 26, 28, and 30. The refrigerant is conducted through evaporator 18, absorbs heat from an external heat exchange medium such as air moving over the evaporator, and vaporizes; and refrigerant vapor proceeds from the evaporator, through headers 36 and 38, and through line 48, which leads back to compressor 12.

Refrigeration system 10 is designed so that the capacity of the system may be varied, and this may be done be reducing the capacity of compressor 12 via capacity control means 20. For example, if compressor 12 is of the reciprocating piston type, the capacity of the compressor and of refrigeration system 10 may be reduced by unloading one or more of the piston cylinders of the compressor. As the capacity of system 10 decreases, the velocity of the refrigerant passing through evaporator inlet lines 44 and 46 and evaporator 18 also decreases. In order to maintain a high refrigerant velocity through evaporator 18, vapor flow through evaporator circuits 24 and 28 is terminated when the capacity of refrigeration system 10 is reduced below a predetermined level; and in accordance with the present invention, this is automatically done by means of flow control device 22 without the need for any solenoid to operate the control device or for any external sensor to sense reduced operating conditions.

Fluid flow control device 22 is illustrated in detail in FIG. 2, and generally the control device comprises body 54, Belleville spring 56, and stop means such as plug 60. Preferably, body 54 includes first and second body sections 62 and 64 and connecting means 66, and plug 60 includes frame 70 and abutment member 72.

Body 54 defines body inlet 74, body outlet 76, fluid flow passage 80 axially extending between the body inlet and outlet, and first and second axially spaced apart shoulders 82 and 84. More particularly, first body section 62 defines body inlet 74 and a first portion of fluid flow passage 80 and includes a first end defining first shoulder 82, second body section 64 defines body outlet 76 and a second portion of fluid flow passage 80 and includes a flange portion defining second shoulder 84, and connecting means 66 connects the first and second body sections together. First and second body sections 62 and 64 may both have a generally tubular shape, have approximately the same outside diameter, and, when connected together, define a generally cylindrically shaped fluid flow passage 80. Preferably, body sections 62 and 64 are contiguous, and connecting means 66 comprises a plurality of mating threads defined by contiguous surfaces of the body sections and releasably connecting the two body sections together. With this arrangement, a seal such as an O-ring is located between contiguous surfaces of body sections 62 and 64 to inhibit vapor flow out of fluid passage 80 between these contiguous surfaces.

Referring to both FIGS. 1 and 2, in assembly, refrigerant line 44 is connected to a first, or forward end of body 54, specifically first body section 62, for conducting refrigerant into body inlet 74; and distributor 32 is connected to a second, or rear, end of the body, specifically second body membe 64, to receive fluid from the fluid flow passage through body outlet 76. As will be understood by those skilled in the art, body 54 may be connected to line 44 and distributor 32 in any suitable manner, for example, distributor 32 may be connected to body 54 by conventional brazing methods; and line 44 may be connected to the body via a complementary, flare fit between adjacent ends of the body and refrigerant line 44 and flare nut 86, which is threaded onto body 54 and compresses together the adjacent, flared ends of the body and line 44.

Belleville spring 56 is positioned within fluid flow passage 80 and includes inside edge 92 and outside edge 94. Inside edge 92 defines radially extending spring port 96 for conducting fluid through Belleville spring 56, and outside edge 94 is located and held between first and second shoulders 82 and 84 in a loose fit with the surfaces of body 54 defining fluid flow passage 80. As is conventional, Belleville spring 56 has a first, or normal, position (shown in full lines in FIG. 2) and a second, or overcenter, position (shown in broken lines in FIG. 2), and the Belleville spring snaps between these two positions as the forces thereon change.

In particular, when there is no net fluid pressure force on Belleville spring 56, the spring is in its normal position. When the fluid pressure acting on the front face of Belleville spring 56 rises above a first level—specifically, a level at which that pressure exceeds the fluid pressure acting on the back face of the spring by more than a first preset amount—the spring snaps inside out, turning into its overcenter position. When the fluid pressure acting on the front face of Belleville spring 56 falls below a second level—specifically, a level at which that pressure exceeds the fluid pressure acting on the back force of the spring by less than a second preset amount, less than the first preset amount—the Belleville spring snaps back overcenter into its normal position. Preferably, while outside edge 94 of spring 56 fits against the adjacent annular surfaces of body 54, the outside edge of the Belleville spring loosely fits against those surfaces. In this way, Belleville spring 56 does not bind against the adjacent annular surfaces of body 54, and the spring is free to snap between its normal and overcenter positions.

Plug 60 defines stop surface 98 disposed within body 54 and radially projecting completely over, and thus completely overlying, spring port 96, and preferably the plug is secured within fluid flow passage 80 between spring 56 and body inlet 74. When Belleville spring 56 is in its first or normal position, inside edge 92 of the Belleville spring engages stop surface 98 to close spring port 96 and prevent fluid flow therethrough, and when the Belleville spring is in its second or overcenter position, the inside edge of the spring is spaced from the stop surface 98 of plug 60 to allow fluid flow through the spring port. With the embodiment of plug 60 shown in FIG. 2, plug frame 70 is secured, for example by soldering, to body 54, specifically to the inside annular surface of first body section 62 adjacent a rear end thereof, although the plug frame may be integral with the first body section. Frame 70 radially extends across fluid flow passage 80; and the frame, of course, defines at least one, and may define a plurality of, openings to allow fluid flow therethrough. Abutment member 72 of plug 60 axially extends from frame 70 toward spring 56, and preferably the abutment member has a generally cylindrical shape with an axis that is coaxial with the axes of body 54, spring 56, and spring port 96. Abutment member 72 may be secured to frame 70 by means such as soldering, or the abutment may be integral with the piston stop frame. In addition to the foregoing, it should be pointed out that preferably first shoulder 82 defines a first radial plane, and stop surface 98 defines a second radial plane axially forward of that first radial plane.

Referring again to both FIGS. 1 and 2, refrigerant fluid discharged from condenser 14 is directed into both evaporator inlet lines 44 and 46; and the refrigerant directed into line 44 flows through expansion device 16, into fluid flow control device 22, past frame 70, and engages spring 56, specifically a forward surface thereof. The design parameters of Belleville spring 56, for example the width of the spring and the size of spring port 96, are chosen so that, when system 10 is operating at full capacity, the pressure of refrigerant on the forward surface of the piston is sufficient to force the Belleville spring into and to maintain the spring in its overcenter position. Of course, when spring 56 is in its overcenter position, spring port 96 is open and refrigerant flows therethrough. Refrigerant thus flows through fluid flow passage 80, and the refrigerant is subsequently directed into and conducted through evaporator circuits 24 and 28.

As the capacity of system 10 is reduced, the pressure of refrigerant flowing through lines 44 and 46 and the pressure of refrigerant acting on the front face of spring 56 decrease. When the fluid forces acting on Belleville spring 56 are insufficient to maintain the spring in its overcenter position, the spring suddenly snaps back into its normal position. Inside edge 92 of Belleville spring 56 engages stop surface 98, and this stop surface completely covers spring port 96, preventing refrigerant flow therethrough. As a result of this, refrigerant is prevented from flowing through fluid flow passage 80 and through evaporator circuits 24 and 28, and substantially all of the refrigerant discharged from condenser 14 is directed into and through line 46 and evaporator circuits 26 and 30. Preferably, when spring 56 is in its normal position, the spring is in pressure contact with both stop surface 98 and second shoulder 84. This pressure contact inhibits fluid flow past or through the outside and inside edges 94 and 92 of Belleville spring 56.

By suddenly moving port 96 from a full open position to a full closed position, control device 22 may be employed to terminate completely fluid flow through evaporator circuits 24 and 28 at a relatively precise fluid pressure level. Fluid flow into evaporator circuits 24 and 28 may be maintained generally unaffected by control device 22 until just prior to the pressure of that fluid falling below a predetermined level where difficulties such as an excessive accumulation of lubricant in evaporator 18 may occur. With the present invention, in order to insure that the fluid flow through evaporator circuits 24 and 28 is completely terminated before the fluid pressure below that predetermined pressure level, it is not necessary, as it might be, for instance, with a modulating type of fluid flow control device, to start to restrict fluid flow through evaporator circuits 24 and 28 and control device 22 while the fluid pressure therein is still appreciably above that predetermined pressure level.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. A refrigeration system comprising:

a compressor, a condenser, expansion means, and an evaporator including first and second evaporator circuits;

means to vary the capacity of the refrigeration system; and refrigerant flow means connecting the compressor, the condenser, the expansion device, and the evaporator together to form a closed loop, vapor compression refrigeration circuit and including first evaporator inlet line means for conducting refrigerant to the first evaporator circuit, and including a refrigerant flow control device for controlling vapor flow through the first evaporator inlet line means, and second evaporator inlet line means for conducting refrigerant to the second evaporator circuit;

wherein the refrigerant flow control device comprises a tubular body defining a body inlet, a body outlet, a fluid flow passage axially extending therebetween, and first and second axially spaced apart shoulders, a Belleville spring positioned within the fluid flow passage, and including an inside edge defining a spring port for conducting fluid flow through the Belleville spring, and an outside edge annularly extending in a close fit with the surfaces of the body and axially located and held between the first and second shoulders, and stop means defining a stop surface disposed within the body and completely overlying the spring port, the Belleville spring having a first position, where the inside edge of the Belleville spring engages the stop surface to close the spring port and prevent fluid flow therethrough, and a second position, where the inside edge of the Belleville spring is spaced from the stop surface to allow fluid flow through the spring port, and the Belleville spring being actuated from the first position to the second position by a predetermined fluid pressure force acting thereon.

2. A refrigeration system as defined by claim 1 wherein the body includes:

a first body section defining the inlet to the fluid flow passage and including a first end defining the first shoulder;

a second body section defining the outlet from the fluid flow passage and the second shoulder; and means connecting the first and second body sections together.

3. A refrigeration system as defined by claim 2 wherein:

the first shoulder defines a first radial plane; and the stop surface defines a second radial plane axially forward of the first radial plane.

4. A refrigeration system as defined by claim 3 wherein the first position of the Belleville spring is a normal position thereof, and the second position of the Belleville spring is an overcenter position thereof.

5. A fluid flow control device comprising:

a body defining a body inlet, a body outlet, and a fluid flow passage axially extending therebetween, and including a first body section defining a first shoulder, a second body section defining a second shoulder axially spaced from the first shoulder, and means connecting the first and second body sections together;

a Belleville spring positioned within the fluid flow passage, and including an inside edge defining a radially extending spring port for conducting fluid through the Belleville spring, and an outside edge annularly extending in a close fit with the surfaces of the body defining the fluid flow passage and axially located and held between the first and second shoulders; and a plug secured within the fluid flow passage between the body inlet and the Belleville spring, and defining a stop surface radially projecting completely over the spring port;

the Belleville spring having a normal position, where the inside edge of the Belleville spring engages the stop surface to close the spring port and prevent fluid flow therethrough, and an overcenter position, where the inside edge of the Belleville spring is spaced from the stop surface to allow fluid flow through the spring port; and the Belleville spring being actuated from the first position to the second position by a predetermined fluid pressure force thereon.

6. A fluid flow control device as defined by claim 5 wherein:

the first body section includes a first end defining the first shoulder, and the first shoulder defines a first radial plane; and the stop surface defines a second radial plane axially forward of the first radial plane.

* * * * *